US006053821A

United States Patent [19]

Palmer

[11] Patent Number: 6,053,821

[45] Date of Patent: Apr. 25, 2000

[54] GOLF TEEING APPARATUS

[76] Inventor: Jack Palmer, 16 Schoolhouse La., Morristown, N.J. 07960

[21] Appl. No.: 09/159,707

[22] Filed: Sep. 24, 1998

[51] Int. Cl.[7] ..... A63B 57/00

[52] U.S. Cl. ..... 473/386

[58] Field of Search ..... 473/386, 132; 294/19.1, 19.2

[56] References Cited

U.S. PATENT DOCUMENTS

| | | | |
|---|---|---|---|
| 1,863,140 | 6/1932 | Mulvaney | 473/386 |
| 4,616,826 | 10/1986 | Trefts | 473/386 |
| 5,080,357 | 1/1992 | Wolf | 473/386 |
| 5,330,178 | 7/1994 | Geishert, Sr. | 473/386 |
| 5,624,333 | 4/1997 | Dayton | 473/386 |
| 5,632,696 | 5/1997 | Nichols et al. | 473/386 |
| 5,669,646 | 9/1997 | Fiocca et al. | 473/386 |

*Primary Examiner*—Steven Wong

*Attorney, Agent, or Firm*—Graham, Curtin & Sheridan; Richard T. Laughlin

[57] ABSTRACT

A light, portable and manually-operated golf ball teeing unit which permits a golfer to position a golf ball on a golf tee without bending over and to press the tee into the ground with the ball positioned on the tee. A tee with an associated golf ball is placed in a locked position between a pair of support means which hold the tee and golf ball. The support means are maintained in the closed position by a spring tension device. The tee so positioned is then pressed into the ground by manually forcing the device downward or by applying foot pressure to a footrest affixed to the device for the manual pressure. When the tee is in the ground, two handles are pivoted apart which causes the support means to pivot apart to allow the device to be removed without interfering with the ball on the tee. Stop posts are provided to limit the amount of pivot of the support means. An auxiliary ball feed can be provided for supplying a number of successive balls to the support means.

13 Claims, 4 Drawing Sheets

GOLF TEEING APPARATUS

FIELD OF THE INVENTION

The invention generally relates to a portable golf teeing device and, more particularly, to such a device which allows placement of the ball and golf tee in alignment with-out the user bending over.

BACKGROUND OF THE INVENTION

U.S. Pat. No. 5,672,121 issued to Miller on Sep. 30, 1997 discloses a portable golf ball teeing device and a golf ball and tee retrieving device. The device has pivoting jaws for holding two golf balls. The device can be operated with one hand and includes a coil spring to keep the jaws in a closed position. A golf ball and tee placed in the device may be set into the ground and handles pulled to release the jaws.

U.S. Pat. No. 5,707,303 issued to Berkowitz et al. on Jan. 13, 1998 discloses a portable golf ball teeing device which has a vertical gripping mechanism of opposed jaw members which grip the golf ball and associated tee and an actuating mechanism for activating and deactivating the jaws. In operation, the jaws are pivoted apart to allow insertion of a golf ball and tee, then pivoted together to grip the tee and golf ball. The apparatus, when not in use for setting a tee, can be used as a support for the user in a resting position. The problem with this device is that the ball and tee have to be manually held by the user in an aligned position until the jaws are pivoted to grip the ball and tee.

U.S. Pat. No. 4,819,938 issued Apr. 11, 1989 to Hill discloses a portable golf teeing device having an elongated handle with a pair of generally concave opposing jaws which are movable relative to one another. The jaws form concave gripping elements which engage a golf ball or tee and allow selective placement of the tee and golf ball relative to one another prior to inserting the tee into the ground. The ball is aligned by a plate on one side of the jaws.

U.S. Pat. No. 4,949,961 issued Aug. 21, 1990 to Milano discloses a portable golf teeing device having a wedge and wheel operated, spring-biased, normally closed clamp at a first terminal end of a handle with a clamp operable and adapted for setting a golf ball on a captured tee.

U.S. Pat. No. 5,669,646 issued Sep. 23, 1997 to Fiocca et al. discloses a portable golf teeing device having a gripper disposed at one end of a long shaft for manipulating golf balls and a tee. The device at the opposite end of the shaft for inserting the tee into the ground is a pair of spring-biased jaws.

U.S. Pat. No. 5,503,394 issued Apr. 2, 1996 to Mauck et al. discloses a portable golf teeing device. The device has a spike which extends into the ground allowing a golf bag to be positioned against the device for holding the bag upright. The device utilizes an elongated spring-loaded tube disposed within an outer tube having a golf ball holder and a gripper for a golf tee on one end thereof. Levers are provided to permit release of the tee and golf ball when the unit has been inserted into the ground.

U.S. Pat. No. 4,616,826 issued Oct. 14, 1986 to Trefts discloses a portable golf teeing device. The device has a pair of arms pivotally mounted at the base of the unit. The arms are spring-biased to engage and support a ball on top of a tee. After the tee is pushed into the ground, hand-operated rods pivot the arms against the spring bias to release the ball and tee.

U.S. Pat. Nos. 2,609,198 and 5,310,177 show asymmetric golf ball and tee setting devices which must be swung away from the set tee and golf ball in given rotational arc. U.S. Pat. Nos. 3,904,200, 4,526,369,4,589,661 and 5,205,598 provide asymmetric devices having a single spring-loaded arm which swings away from the set ball and tee in a given direction.

Most of these devices have vertical jaws for holding the golf ball which prevents independently aligning the golf tee. Further, the devices lack stability. In most devices, the operator must hold and support the unit when placing and releasing the ball. This requires very steady hands because the slightest movement can knock the ball off the tee. This disadvantage is compounded by the fact that people with health problems are most likely to use this type of apparatus. The devices also have difficulty in setting the tee and ball in the unit and opening up spring-loaded jaws. The devices are also complicated to manufacture, since most of the devices use a scissors-type motion. The devices are not free-standing on the ground.

It is an object of the invention to provide a golf teeing device which is simple in construction and allows the tee and golf ball to be inserted separately into the device. It is another object of the invention to provide such a device that transmits and applies a substantially centrally aligned axial force to the golf ball. It is a further object of the invention to provide such a device which is compact and easy to use, with a base plate that allows the device to be free-standing. It is a still further object to provide such a device which contains a removable ball stop to allow feeding of golf balls. Another object is to provide storage areas for both golf balls and golf tees. Other objects and the advantages of the invention will appear from the following description of the invention.

SUMMARY OF THE INVENTION

Golf ball and teeing devices which do not require bending of the user are not generally available because none of the suggested constructions have resulted in a practical, modestly-priced device. In such a device, it is necessary for it to be of a cane type of construction having sufficient length so that bending is not necessary. The device must be able to allow the tee and ball to be inserted in the device while the golfer is in an upright or seated position. The device must hold the tee in a fixed position with the ball located on top of the tee, so that when the tee is pressed into the ground the ball is positioned on the tee. The device must be removable without knocking the ball off the tee, which is a common occurrence when inserting a tee and ball by hand.

In accordance with the invention, a cane device is provided for setting a golf ball and tee without requiring the user to bend over. The device has two parallel shafts, each having a proximal end and a distal end. The proximal ends are bent in a generally right angle to form handles. The distal end of each shaft is affixed to the plate to permit free standing of the device in an upright position and to permit rotation of the shafts. The base plate is provided with an opening to permit passage of a golf ball through the plate. Two horizontal support means are located above the base. Each of the support means is affixed to one of the shafts. The support means in a closed position have a cup configuration to hold a golf ball. The support means also have an opening to allow insertion of a tee in a loose-fitting position. The opening is small enough to allow the shaft of the tee to pass through, but not the head of the tee. The tee rests in such a position independent of the golf ball, but the opening has to have a conical shape so the tee will be maintained in a vertical position. Gravity is utilized to hold the tee in place;

there is no gripping of the tee. The support means, when in a closed position, cradle the golf ball in an aligned position with the golf tee.

A stop element is located above the positioned golf ball to hold the aligned golf ball in place while the device is being pressed against the ground to fix the golf tee in place. A bearing for holding the rods in a spaced-apart position at their proximal ends is provided, which allows axial rotation of the rods. A tension means holds the rods in a fixed relationship which in turn holds the support means in a closed position. When horizontal hand pressure is applied to each rod, the rods rotate axially. This rotation causes the two support means to separate to allow clearance of the golf tee and golf ball after the tee has been pressed into the ground. The tee is pressed into the ground by the action of placing the device on the ground.

A ball cartridge can be provided for holding a number of golf balls in vertical alignment. A stop is provided so that only one golf ball is in relation to the tee. When the next ball is needed, the stop is swung out of the way to permit the dropping of a golf ball in place, then the stop is swung back to prevent the other ball from interfering with the operation.

In practice, the user places a golf tee in the conical hole formed by the two support means being in a closed position. A golf ball is then inserted into the cradle also formed by the closed support means. The apparatus is then set on the ground and pressed downward, which inserts the tee into the ground. The handles are rotated outwardly which causes the support means to swing apart and release the ball and golf tee. The device is then lifted upright to avoid hitting the ball and the handles released, which causes the support means to return to the closed position. The use of the plate at the bottom of the apparatus permits the tee and golf ball to be placed in the correct alignment with the ground. Without the plate, the golf ball could fall off the golf tee.

BRIEF DESCRIPTION OF THE DRAWINGS

The foregoing and other objects, features and advantages will be apparent from the following description of the preferred embodiment of the invention as illustrated in the accompanying drawings.

DESCRIPTION OF THE PREFERRED EMBODIMENT

Figure 1:
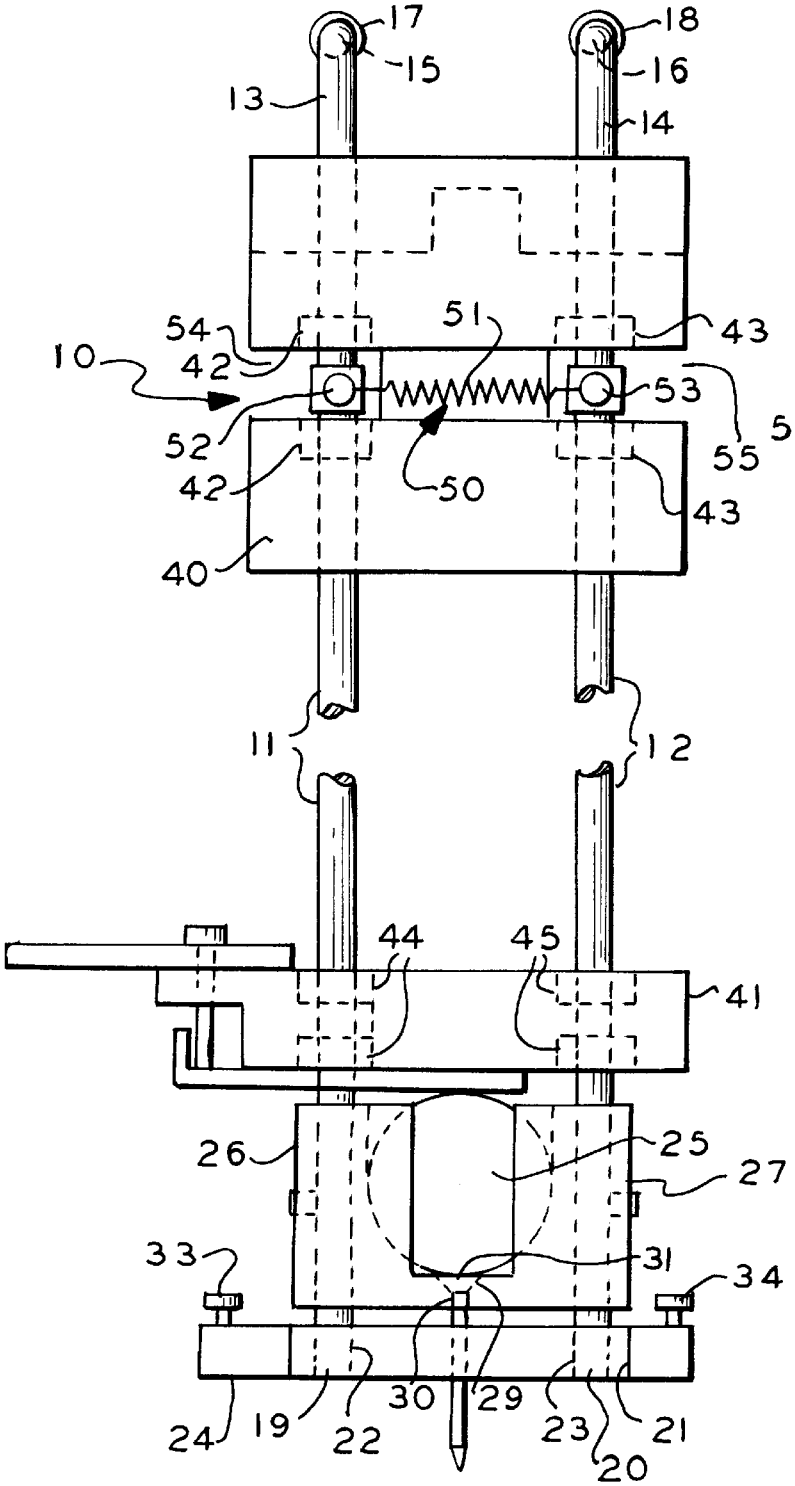
FIG. 1 is a front view of the apparatus.
Figure 2:
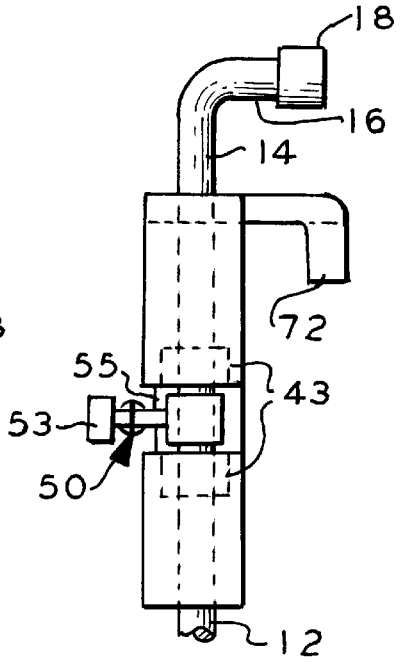
FIG. 2 is a partial side view of the apparatus showing the upper bearing arrangement.
Figure 3:
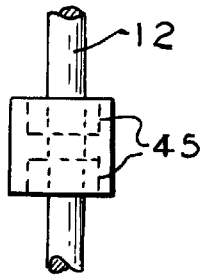
FIG. 3 is a partial side view of the apparatus showing the lower bearing arrangement.
Figure 4:
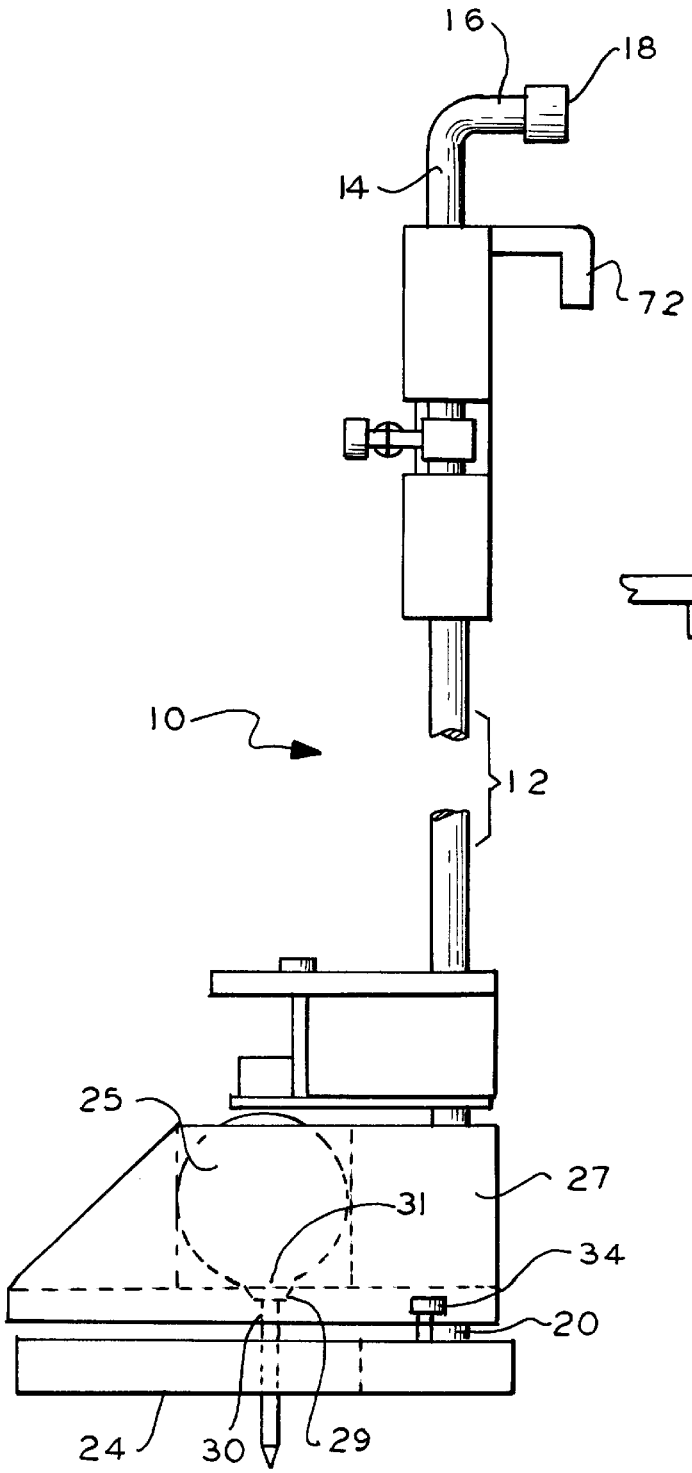
FIG. 4 is a front view of the apparatus.
Figure 7:
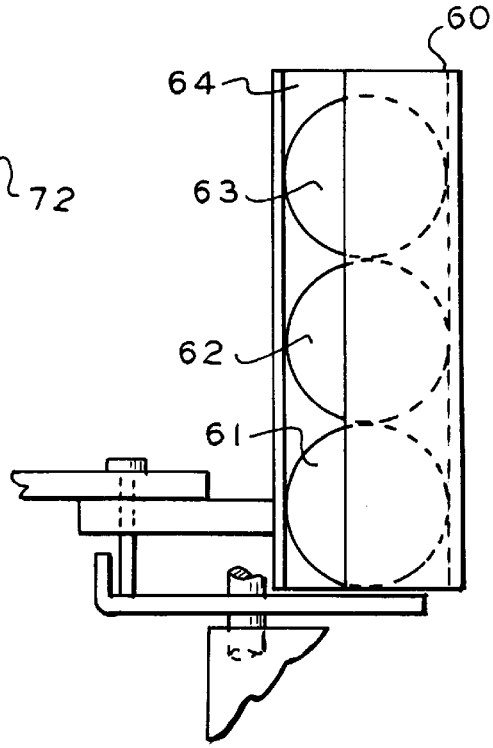
FIG. 7 is a top view showing the configuration of the stop means.
Figure 8:
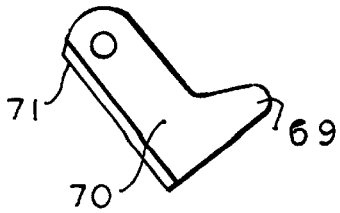
FIG. 8 is a top view of the stop plate.
Figure 5:
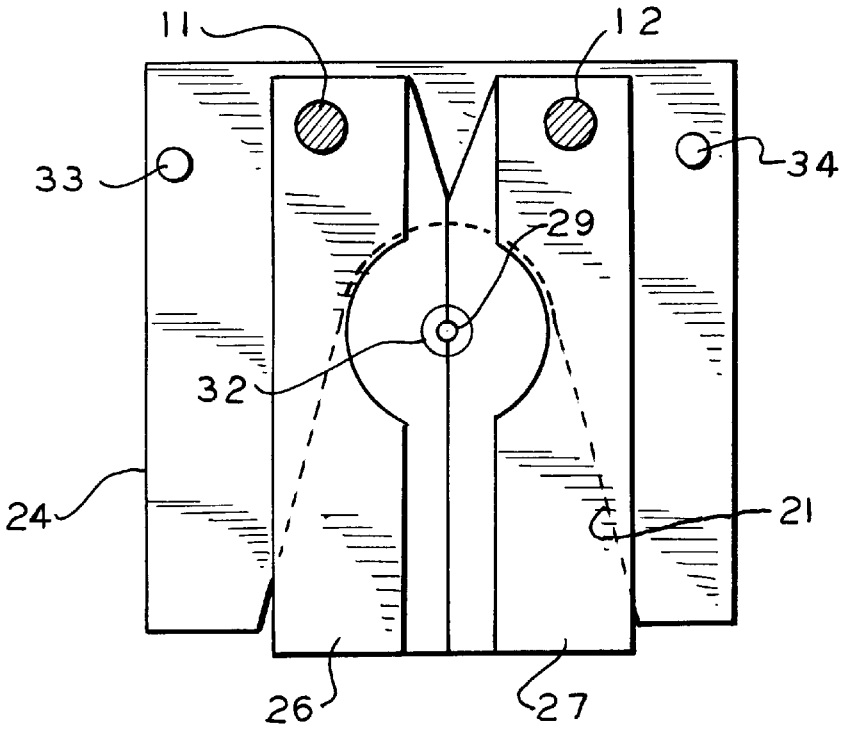
FIG. 5 is a top elevation of a part of the apparatus showing the support means in an open configuration.
Figure 6:
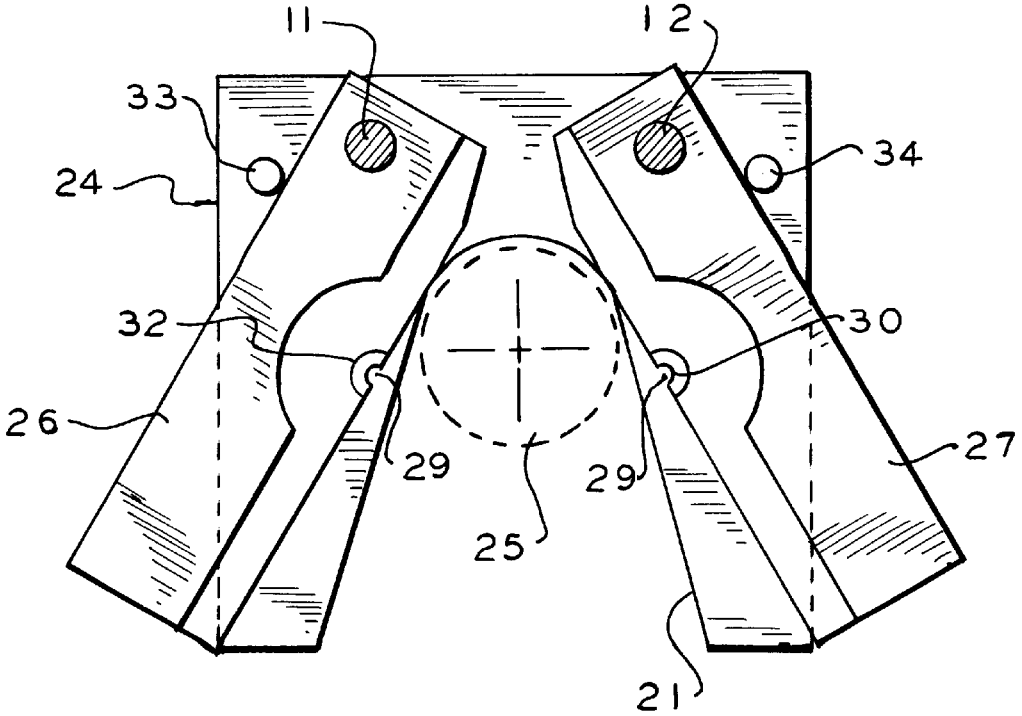
FIG. 6 is a front elevation showing a golf ball cartridge.

In the following description, numerals appearing in this specification and in the drawings correspond to the elements listed as follows:

| | |
|---|---|
| 10 | golf ball and tee setting device |
| 11,12 | vertical parallel shafts |
| 13,14 | proximal ends of shafts |
| 15,16 | handles on the shafts |
| 17,18 | rubber or plastic caps |
| 19,20 | distal ends of shafts |
| 21 | cutout in base plate |
| 22,23 | shaft journals |
| 24 | base plate |
| 25 | golf ball |
| 26,27 | horizontal support means |
| 29 | tee opening in support means |
| 30 | shaft of golf tee |
| 31 | head of the golf tee |
| 32 | conical shaped opening |
| 33,34 | stop pins |
| 40 | upper spacer bar |
| 41 | lower spacer bar |
| 42,43,44,45 | bearings in each spacer bar |
| 50 | tension means |
| 51 | tension spring |
| 52,53 | securing projections |
| 54,55 | slot in the spacer bar |
| 60 | ball cartridge |
| 61,62,63 | golf balls |
| 64 | vertical opening |
| 69 | projection finger |
| 70 | stop plate |
| 71 | raised edge on stop plate |
| 72 | storage hook |

Figure 9:
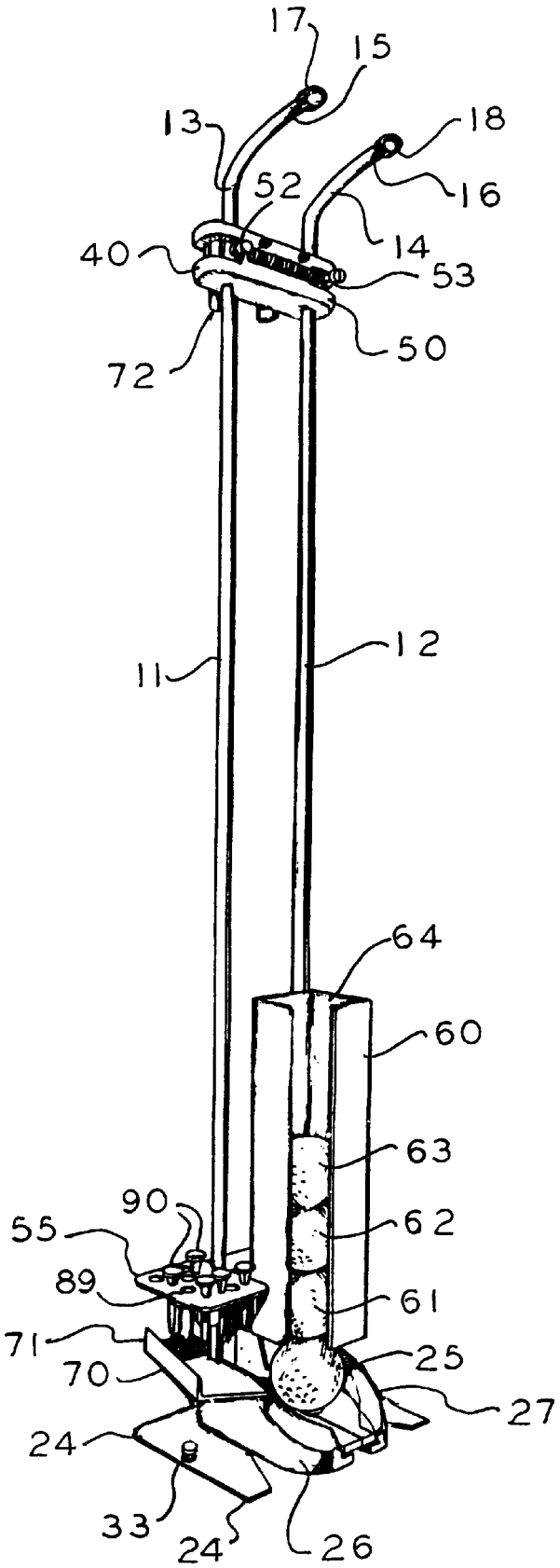
FIG. 9 is a perspective view of the device shown in FIG. 1.

Briefly, the present invention includes a hand-operated apparatus for setting a golf ball on a golf tee without requiring the golfer to bend down. The ball and tee can be inserted in the apparatus while the golfer is sitting or standing. Referring to FIGS. 1 and 9, a tee setting device is generally indicated at 10. The device has two vertical parallel shafts 11, 12 having proximal ends 13, 14 which are bent in a generally right angle to form handles 15, 16. The handles 15, 16 can have rubber or plastic caps 17, 18. The distal ends 19, 20 are journaled 22, 23 to a base plate 24. The journals 22, 23 can be a conventional bearing or simply a hole in the base plate 24 to allow free rotation of the shafts 11, 12. The base plate 24 allows the whole apparatus to rest on the ground in a stable, upright position with the base plate 24 resting on the ground. The base plate 24 also allows correct alignment of the ball and tee into the ground. The base plate 24 has a cutout 21 which is large enough to allow the free passage of a golf ball 25 through the plate when the golf ball is released. The cutout can generally be in the form of a "V" for ease of fabrication.

Two horizontal support means 26, 27 are located above and adjacent to the base 24. Each support means 26, 27 is affixed to one of the shafts 11, 12 so that when the shaft is rotated, the associated support means pivot at the affixed end to allow passage of the golf ball downward when the apparatus is moved vertically away from the ball. The support means 26, 27 are configured so that in a closed position they form a cup configuration 28 to hold a golf ball. The support means 26, 27 have an opening 29 to allow the insertion of a tee in a loose fitting position. The opening 29 is small enough to allow the shaft of the tee 30 to pass through, but retains the head 31 of the tee. The head 31 of the tee rests in such a position independent of the golf ball 25, but the opening 29 has to have a conical shape 32 so the tee will be maintained in a vertical position in the closed support means 26, 27. Gravity is utilized to hold the tee in place in the aligned position. There is no gripping of the tee by the support means 26, 27. The support means when in a closed position cradle a golf ball 25 in an aligned position above the golf tee head 31.

Upper 40 and lower 41 spacer bars hold the vertical rods 11, 12 apart without interfering with there rotation. The rods 11, 12 extend through bearings 42, 43, 44, 45 in each spacer. The bearings 42, 43, 44, 45 allow axial rotation of the rods in the bearings. A tension means 50 holds the rods 11, 12 in a fixed relationship which in turn holds the support means 26, 27 in a closed position. The tension 50 means can be a conventional tension spring 51 extended between projections 52, 53 affixed to each rod and extending out a slot 54, 55 in the spacer bar 40. The projection 52, 53 can be a conventional bolt. When horizontal hand pressure is applied to each rod 11, 12, the rod rotates axially. This rotation causes the two support means 26, 27 to pivot and separate to allow clearance of the golf tee 30 and golf ball 25 after the tee has been pressed into the ground.

A stop plate 70 is located above the positioned golf ball 25 to hold the aligned golf ball in place when the device is being pressed against the ground to fix the golf tee in place, i.e., when vertical pressure is applied to the tee to insert it into the ground. Since the tee is not held in position by the support means, it is essential to the invention that a stop plate 70 is utilized so the tee will not be displaced and will go into the ground. The stop plate can be pivotally connected to the lower spacer bar 41 and swung into place by hand movement. The stop plate 70 can have a raised edge 71 to aid in grasping the stop plate by utilizing the foot of the user. The stop plate 70 can have a slim projection finger 69 for holding the golf ball in place. The tee is pressed into the ground by the action of placing the device 10 on the ground. A foot plate 55 or tee storage can be affixed to the lower space bar 41. Holes 89 are provided in the foot plate to hold tees 90. A storage hook 72 can be affixed on the back of the device 10, such as at the upper spacer bar, so the device can be stored or affixed to a golf bag.

A ball cartridge 60 can be provided for holding a number of golf balls 61, 62, 63 in vertical alignment. The cartridge can be a rectangular sleeve having a vertical opening 64 to allow alignment of the golf balls. The stop plate 52 is configured so only one golf ball is fed in relation to the tee. When the next ball is needed, the stop plate 52 is swung out of the way to permit dropping of the next golf ball into place and the stop plate 52 swung back to prevent the other balls from interfering with the operation.

In practice, the user slips a golf tee into the conical hole formed by the two support means being in a closed position. A golf ball is then inserted into the cradle also formed by the closed support means. The cradle has sufficient height to hold the ball. The stop element is then moved by hand so that it presses on top of the ball. The ball and tee thereby become stable and can be moved about without the ball or the tee changing alignment. The apparatus is then set on the ground on ward which inserts the tee into the ground. The handles can then be rotated outwardly which causes the support means to swing apart and release the ball onto the embedded golf tee. The support means are stopped at the desired extension by stop pins 33, 34. The device is then lifted upright to avoid hitting the ball. The handles can then be released which causes the support means to return to the closed position. The use of the plate at the bottom of the apparatus permits the tee and golf ball to be placed in correct alignment with the ground. It also allows the apparatus to be set for storage or use in an upright position.

While the invention has been described in its preferred embodiment, it is to be understood that the words which have been used are words of description rather than limitation, and that changes may be made within the purview of the appended claims without departing from the true scope and spirit of the invention in its broader aspects. Various modifications of this invention will be apparent to one skilled in the art and insofar as such modifications are within the scope of the invention, they are intended to be included within the scope of the claims.

What is claimed is:

1. A cane device for setting a golf ball and a golf tee having a pointed elongated body portion and a larger head portion on the opposite end without requiring the user to bend over, comprising two parallel shafts each having a proximal end and a distal end;

a base plate journaled to the distal end of each shaft to permit free standing of the device in an upright position and rotation of the shafts;

the base plate having an opening to permit passage of a golf ball through the plate;

two horizontal support means having a closed and open position located above the base for cradling a golf ball on top of a golf tee;

each of the support means being affixed at one end to one of the shafts;

the two support means in a closed position forming a vertical conical opening to align a golf tee in a vertically aligned position independent of the golf ball and a golf ball cradle for supporting the golf ball in an aligned position with the golf tee;

a stop element located above the positioned golf ball to hold the aligned golf ball in place when the device is being pressed against the ground to fix the golf tee in place;

a journal block on the proximal end of each rod having a handle;

a bearing for holding the rods in a spaced-apart position at their proximal ends which allows axial rotation of the rods;

tension means for holding the rods in a fixed relationship and which, when horizontal pressure is applied to each rod, allows the rods to rotate axially; and the horizontal pressure causes the two support means to separate to allow clearance of the golf tee and golf ball after the tee has been pressed into the ground by the down-ward movement of the device by the user.

2. The device according to claim 1 wherein the base has opposing vertical stop means for limiting the opening movement of each support means.

3. The device according to claim 1 wherein a storage means is affixed to the bearing.

4. The device according to claim 1 wherein said tension means is a tension spring which returns the support means to the closed position by rotating the rods.

5. The device according to claim 4 wherein said one end of the spring is affixed to one rod and the opposite end is affixed to the second rod.

6. The device according to claim 4 wherein a bracket is affixed to each rod, each bracket extends through a slot in the bearing and is affixed to opposite ends of the tension spring.

7. The device according to claim 1 wherein the rods extend above the bushing and are bent in a generally horizontal direction to form the handles.

8. The device according to claim 1 wherein a second bearing is located adjacent to the support means and affixed to the base plate.

9. The device according to claim 1 wherein a pressure plate is affixed to the second bearing to allow the foot of the user to rest on the plate, stabilize the device when in use and force the golf tee into the ground.

10. The device according to claim 1 wherein a golf ball holder is provided for holding a number of golf balls in horizontal alignment above the support means and affixed to the second bearing.

11. The device according to claim 1 wherein a stop plate for limiting the downward flow of the golf balls in the golf ball holder is pivotally connected to the pressure plate which when pivoted in one direction will prevent the downward flow of golf balls and when pivoted in the opposite direction will allow the discharge of one golf ball from the holder to the support means.

12. The device according to claim 1 wherein an edge of the stop plate extends in the vertical direction to form a pressure edge to allow the user's foot to control the movement of the stop plate.

13. The device according to claim 10 wherein the golf ball holder comprises a rectangular sleeve having a vertical cutout to view a portion of each golf ball in the sleeve.

* * * * *